US010004314B2

(12) United States Patent
Barnes

(10) Patent No.: US 10,004,314 B2
(45) Date of Patent: Jun. 26, 2018

(54) METHOD FOR SUPPORTING HEALTHY LONG NAIL GROWTH AND MECHANISM OF NAIL REINFORCEMENT

(71) Applicant: Donna Geraci Barnes, Salisbury, NC (US)

(72) Inventor: Donna Geraci Barnes, Salisbury, NC (US)

( * ) Notice: Subject to any disclaimer, the term of this patent is extended or adjusted under 35 U.S.C. 154(b) by 296 days.

(21) Appl. No.: 14/884,969

(22) Filed: Oct. 16, 2015

(65) Prior Publication Data

US 2017/0105505 A1 Apr. 20, 2017

(51) Int. Cl.
*A45D 29/00* (2006.01)
*A45D 31/00* (2006.01)

(52) U.S. Cl.
CPC ..... *A45D 29/00* (2013.01); *A45D 31/00* (2013.01); *A45D 2029/008* (2013.01)

(58) Field of Classification Search
CPC ..... A45D 31/00; A45D 29/001
See application file for complete search history.

(56) References Cited

U.S. PATENT DOCUMENTS 5,005,595 A * 4/1991 Aylott ..... A45D 31/00 132/200
5,450,864 A * 9/1995 LaJoie ..... A45D 31/00 132/285
5,467,787 A * 11/1995 Mast ..... A45D 31/00 132/73
5,676,165 A * 10/1997 Bannett ..... A45D 31/00 132/73
5,924,427 A * 7/1999 Jensen ..... A45D 31/00 132/200

* cited by examiner

*Primary Examiner* — Sarah Burnham McPartlin

(57) ABSTRACT

A flexible under-nail support device and method to apply the same that promotes long healthy fingernail growth by providing nail strength and support without any interaction or damage to the nail plate (upper nail) or the hyponychium (thickened epidermis under the nail). The device has an indention, with a preferred embodiment of an inverted V that is positioned under the fingernail and around the hyponychium. Its lateral sides are bonded to at least the nails' lateral undersides to provide extra strength to the nail. The bonded device is then clipped and filed to the natural nails length. The method includes healthy easy device removal and support replacement. As the nail grows, the process of attaching and removing supports is repeated and over time results in strong, long, healthy, aesthetically pleasing nails. For immediate nail lengthening, the device may be used as scaffolding with other technologies mitigating their respective health hazards.

3 Claims, 3 Drawing Sheets

METHOD FOR SUPPORTING HEALTHY LONG NAIL GROWTH AND MECHANISM OF NAIL REINFORCEMENT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION (1) Field of the Invention

This invention relates to an under-nail support apparatus and to a method of applying the support to a fingernail that allows the nail to grow while preventing disease and damage to the nail plate (nail top) and to the hyponychium (skin under the nail) and thus promotes longer and more beautiful nail beauty without degrading nail health.

(2) Description of Related Art

It has become common practice among a large percentage of women to have nails which are aesthetically pleasing and sometimes lengthy to create a "finished' look. But, the everyday activities of cooking, cleaning, typing, performing manual labor and the like, expose hands to nail injury. As a result, it is necessary to clip damaged nails thwarting the achievement of the desired look. The desire for stronger, longer or more beautiful nails, may not just be aesthetic. Individuals like classical guitarists depend upon strong nails and may have need to reinforce their nails in a safe and healthy way.

To support a finished look, several artificial nail lengthening techniques have entered the marketplace. Many of the techniques providing a desired look or strength, require an anchor to the top live part of the exposed natural human fingernail. (For example, U.S. Pat. No. 6,354,304 to Yong Jin Chang, U.S. Pat. No. 5,638,835 to Joann Franz and Rudolph Liedtke, and U.S. Pat. No. 5,832,936 to Sandra and Bruce Pruchnic). These artificial fingernails, which are placed directly on top of the natural nail, are relatively easy to use but they provide a temporary solution due to "popping" off. Other popular and longer-lasting artificial nail lengthening solutions include, but are not limited to, gel nail, silk wraps and acrylic nails. All of these methods may negatively impact nail health.

Acrylic nail technologies bond an artificial nail tip to the distal end of the live part of the natural fingernail. As a result, a step-down ridge is created by the interface of the top surface of the natural nail and the artificial tip. This ridge is filled in with an acrylic substance. Since acrylic does not adhere well to the natural skin layer on top of the human nail, the skin layer is removed by filing and/or buffing the nail plate (top of the nail), which often weakens and damages the nail plate. Once the skin layer is removed, the entire top of the now weakened natural nail is covered with the liquid acrylic substance which hardens as it dries. Because the human nail continues to grow, regular fill-ins with the acrylic substance are necessary to maintain attractive nails. The fill-in cycle of covering the abraded nail plate with acrylic, growing of the nail, the nail ridge appearing then subsequently filling in with more acrylic creates a dependency upon the technology to maintain the look associated with acrylics as they are currently used. Each fill-in cycle further deteriorates the natural nail and when the user stops using acrylics, she is often left with an indentation in the nail plate. Upon removal, this technology can damage the nails even more. Acrylic is hard to remove and requires lengthy chemical soaks further worsening the nail condition. Removal can also involve pulling on the nail causing pain and separation of the nail plate from the nail bed.

Gel nails are similar to the acrylic. They too require filing down the natural nail top before the application of gel. But gel also has the unique and added disadvantage of repeated exposure to harmful UV lights.

Regardless of the technology (i.e. acrylic tips, acrylic, gel, silk wraps) used to lengthen the nails, they all require the filing and buffing nail tops, bonding directly to natural nail, filling in as the nail grows and using of chemical soaks for removal. The common disadvantage of the present techniques is they involve interaction directly with the top of the live exposed natural fingernail and compromise the strength, thus weakening the nails natural ability to maintain length and also leave them vulnerable to disease. Another disadvantage is that these methods promote fungal or bacterial growth between the layer of the natural human nail plate and the artificial nail. These methods are expensive, time-consuming and counterproductive to human fingernail health and growth.

Prior art recognizes the need for an artificial nail device that would not involve the top of the fingernail but rather supports the nail from underneath. U.S. Pat. No. 4,408,622 to Carl H. Meyerhoefer represents a hybrid over and under the fingernail approach to enhance the nail. Here, the convex edge of the fingernail is inserted into an artificial wedge-shaped fingernail extension and then bonded. In U.S. Pat. No. 6,003,518 to Stephany L. Jensen, also uses an over/under fingernail approach. Specifically, a flexible preferably silk material is adhered to the nail and lateral sides of the device are folded around the fingernail. In U.S. Pat. No. 4,135,562 to Eva Matragna and Yosh Hukama. This prior art utilizes a crescent-shaped underside artificial nail with a stop step that abutted the living nail. U.S. Pat. No. 5,005,595 to David H. Aylott invented a similar crescent-shaped method with an attached application handle, which is removed after the fingernail support is placed. And, U.S. Pat. No. 5,806,537 to Juliet Wittwer presented an apparatus providing artificial support from underneath the nail. The support "wherein the inside end of said artificial support nail is shaped to contact the finger where the finger and natural nail come together. The interface where the nail and nail come together is the hyponychium. Stephany L. Jenson in U.S. Pat. No. 5,924,427 presented a nail reinforcing device conforming to the underneath surface of the natural fingernail. It "has a rearward curved (convex) edge to butt up against the front of the finger when placed under the nail." This location is where the hyponychium is found.

All the prior under-nail support systems have had their own set of problems, specifically the interaction between the convex crescent shape and the skin under the human fingernail called the hyponychium. Since the hyponychium, the protective bed of soft tissue (or skin) under the human fingernail, is extremely sensitive and easily damaged, devices that abut against this soft tissue can cause damage, including bleeding and severe pain and promote both bacterial and fungal infections. The previous under-nail devices can cause pain and infections resulting in the user not being able to be use them successfully. Additionally the shallowness of crescent shape made it impossible for previous art to reach, strengthen or support the fingernails lateral and leading edges which is typically where nail damage occurs. Such complications may be the reason why in a society where long finished nails are often sought after and preferred, we do not have a useable under-nail alternative, until now.

BRIEF SUMMARY OF THE INVENTION

By way of this invention, the under-nail support and method for applying the support avoids the hyponychium (thickened epidermis under the nail that protects the nail bed) and supports the most vulnerable parts of the nail plate, specifically the lateral and leading edges. By avoiding the living part of the nail plate and bed, the under-nail support does not enhance the likelihood of physical, chemical, radiational and microbial damages associated with current nail technologies. The preferred embodiment is an inverted "V" shaped flexible plastic support that is quick and easy to apply and comes in a variety of sizes to fit any nail size. Through the process of device application, nail growth, device removal and device replacement, the wearer can lengthen, strengthen and beautify natural nails. The invention lends itself to home application with a kit in a matter of minutes or at a salon for those who like to be pampered. Furthermore, the support may be used with current technology such as a scaffold for sculpting acrylic. When this invention is paired with acrylic technology, the damage to the nail is avoided but the length and beauty of acrylics are provided.

DETAILED DESCRIPTION OF INVENTION

Figure 1:
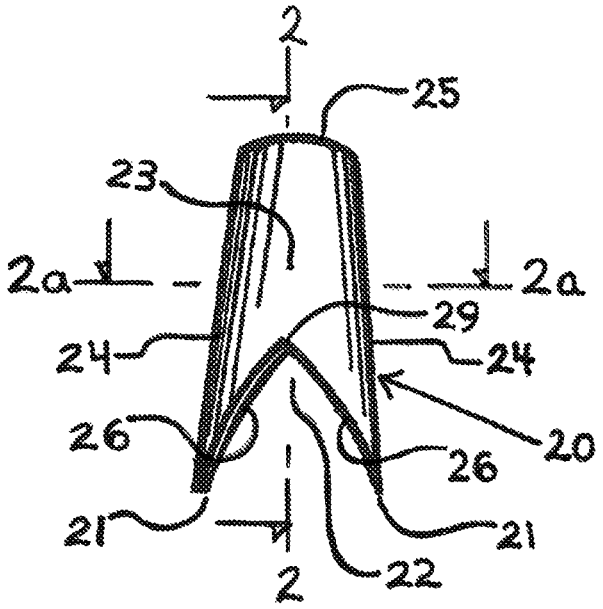
FIG. 1 is a plan view of a preferred embodiment of the under-nail growth supporting device with an inverted "V" shaped indention.
Figure 2:
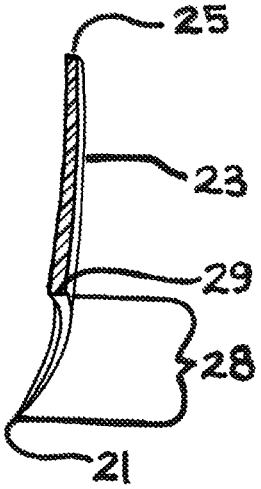
FIG. 2 is a section on line 2-2 of FIG. 1.
Figure 2A:
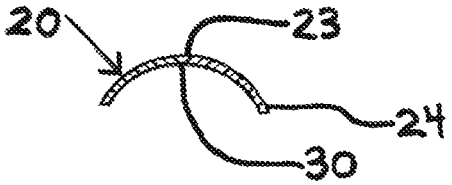
FIG. 2A is a section on line 2*a*-2*a* of FIG. 1.

FIGS. 1 and 2 show the under-nail support 20 with an extended body 23. The support 20 is a thin, flexible, preferably plastic element with a rearward or proximal edge 26 and two lateral edges 24 that taper distally toward the support's tip 25. The preferred thickness of the support 20 is approximately 0.127 millimeters (0.005 inches) to 0.508 millimeters (0.020 inches). The preferred shape of the under-nail support's proximal edge 26 is an inverted V shape 28 with two cusps 21 that create a recess 22, approximately as deep as it is wide, which when bonded to the nail, avoids the sensitive hyponychium 35 and reinforces the nail at its most injury-prone areas of the lateral and distal edges of the free edge 34. FIG. 2 is a section on line 2-2 of FIG. 1 revealing the recommended proportion of the V shape 28 to the extended body 23. Such bisection highlights one cusp 21 and the vertex 29 of the V shape 28. FIG. 2A is a section on line 2*a*-2*a* of FIG. 1 FIG. 2A reveals a flexible arch 30 of the extended body 23 that promotes sound attachment of the support 20 deep into the nail grooves 36 regardless of whether a user has flat or arched nail plates 32.

Figure 3:
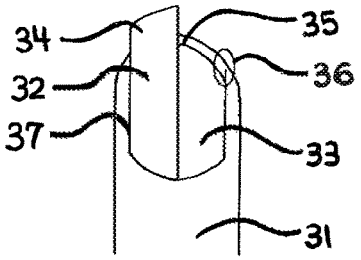
FIG. 3 is a reference diagram of a human finger with the fingernail halved to highlight the hyponychium and other parts of the nail anatomy.

FIG. 3, is a diagram of the human finger 31 revealing the top of the nail or nail plate 32 that is often painted. The nail plate 32 rests on the nail bed 33. The free edge 34 is the section shaped during a manicure and grows distally from the nail bed 33. The thickened epidermis under the free edge 34 is the hyponychium 35 which is the sensitive area of soft skin underneath a fingernail. The nail walls 37 are the folds of skin adjacent to the nail bed 33 and help to keep the nail plates 32 attached. The nail grooves 36 are found under both sides of the free edge 34 and are indicated by the area circled.

Figure 4:
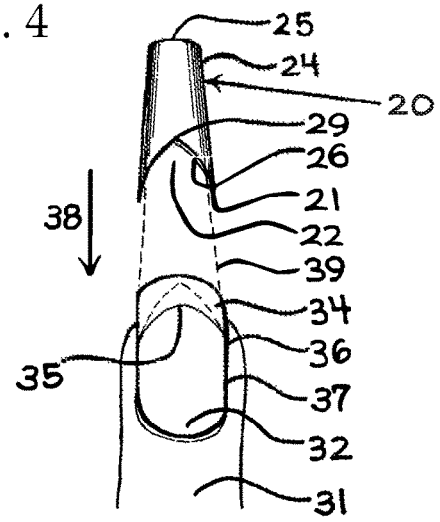
FIG. 4 is a top perspective view of artistry represented in FIG. 1 showing proper placement of the under-nail support under the human fingernail represented in FIG. 3.

The preferred placement 39 (represented by the dotted line) of the under-nail support 20 is highlighted in FIG. 4. For maximum support of and reinforcement of the nail walls 37 and the tear-prone lateral and distal edges of the free edge 34, the user should position the cusps 21 deeply into the nail grooves 36 under the free edge 34. Such placement also positions the recess 22 to avoid the hyponychium 35.

Figure 5:
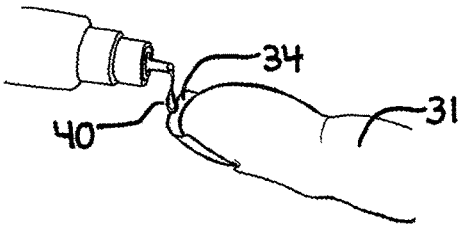
FIG. 5 is a perspective view showing glue placement.
Figure 6:
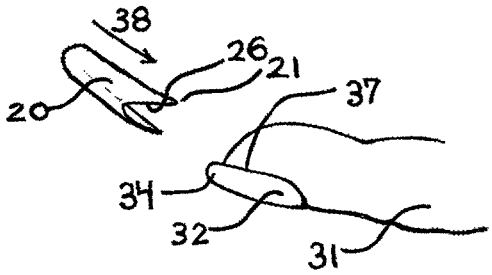
FIG. 6 shows placement direction of under-nail support before bonding.
Figure 7:
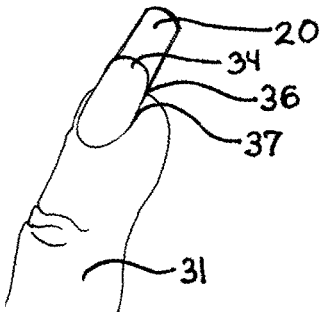
FIG. 7 is a palm-side-down view of a human nail with the support device bonded underneath before clipping and filing.
Figure 7A:
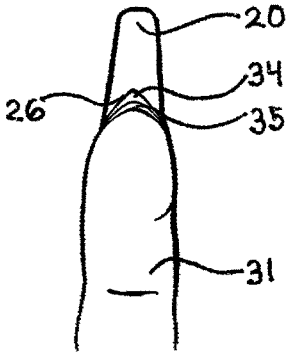
FIG. 7A is a palm-side-up view of a human nail with the support device bonded before clipping and filing.
Figure 8:
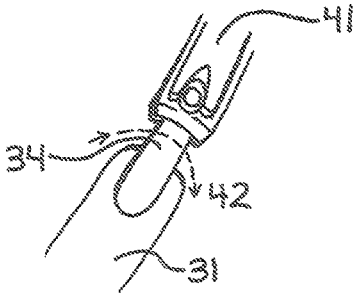
FIG. 8 is a perspective view of a human nail with support bonded underneath being clipped to the length of the natural nail.
Figure 9:
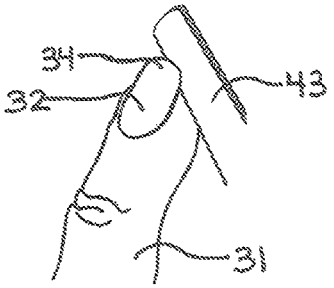
FIG. 9 is a perspective view of filing the reinforced nail of FIG. 8 after clipping.

FIGS. 4, 5, 6, 7, 8 and 9 address the method of applying the under-nail support 20. To apply, check for the proper size and placement 39 of the under-nail support 20 by properly positioning the support 20 under the nail as illustrated in FIG. 4. Turn the hand palm up and place a drop of a quick-drying adhesive 40 like Super Glue® under the free edge 34 regardless of the length of the nail as illustrated in FIG. 5. To bond the nail and support 20, (see FIG. 6), hold the support 20 away from its proximal edge 26 and quickly place the cusps 21 to the underside of the free edge 34 in the direction indicated by 38. Slide the support 20 under the free edge 34 until it comfortably, yet firmly, fits against the nail walls 37, within the nail grooves 36, and around the hyponychium 35. Hold the support 20 in position for 5 to 15 seconds or until fastened securely. FIGS. 7 and 7A reveal a top-lateral and palm-side-up directional views, respectively, of the supported nail once the support 20 is adhered to the nail's free edge 34. Once the support 20 is attached, cut the distal edge of under-nail support 20 with scissors or clipped with nail clippers 41 to a length slightly longer then the natural nail. FIG. 8 suggests the pathway 42 for the now supported nail to be cut or clipped. After cutting the support 20, refine the shape of the under nail support 20 with a file 43 to blend with the nails free edge 34 as shown in FIG. 9. Now that the support 20 is in place, the reinforced nail is allowed to grow protected where it is most likely to tear (the lateral and leading edges) and the hyponychium 35 has a generous buffer from irritation.

Figure 10:
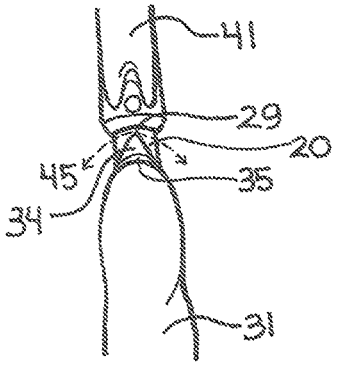
FIG. 10 is a palm-side-up view of the nail and support after the nail has grown right before removing support.

After the supported nail has grown, FIG. 10 demonstrates the quick mechanical removal of the support 20. With fingernail clippers 41, clip the now longer free edge 34 with its attached support 20 from the vertex 29 of the V 28 to the left and from the vertex 29 to the right as illustrated by the bidirectional arrow 45. As a result of this trim, the under-nail support 20 typically splits off as pictured in FIG. 11. If needed, one can use the point of a clipper 41 or metal file and gently help pop off any remaining support 20 attached to the nail's free edge 34. Once removed, a new under-nail support 20 can be attached to a now longer nail. When the desired length is reached, individuals can maintain their own natural long nails by growing and trimming their nails in a customary manner and repeating the steps illustrated in FIGS. 4-11.

Figure 12:
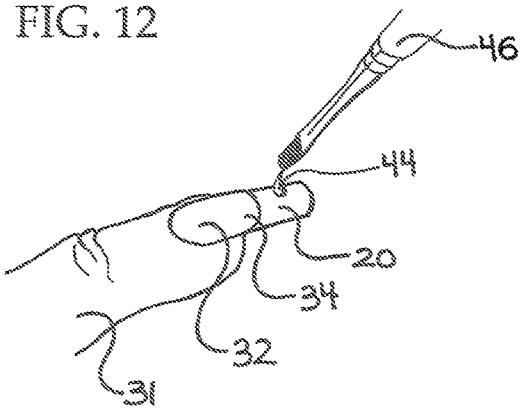
FIG. 12 is a perspective view of lengthening a fingernail by applying a monomer/polymer sculpted acrylic mix on the under nail support after the support is adhered as seen in FIG. 7.
Figure 13:
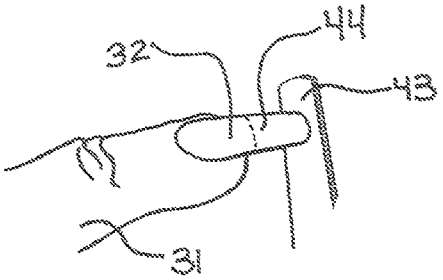
FIG. 13 is a perspective view of the filing the dried sculpting acrylic mix and under nail support.

FIG. 12 illustrates how a person may use a combination of the support 20 with monomer/polymer sculpting acrylic 44 to give nails a longer desired look quickly and safely. Attach the support 20 by repeating steps illustrated in FIGS. 4, 5, 6, and 7 and clip the support 20 past the free edge 34 to a desired length, longer than the nail. Next, do not buff, drill or damage the living parts of the nail (the nail plates 32 and beds 33), rather apply a monomer/polymer sculpting acrylic 44 with a brush 46 to the surface of the support 20 only and carefully fill in the step down created by the support 20 having been applied to the underside of the free edge 34. After the sculpting acrylic 44 is allowed to dry, the user should shape with a file 43 the support 20 with its dried layer of sculpting acrylic 44 as illustrated in FIG. 13.

Figure 11:
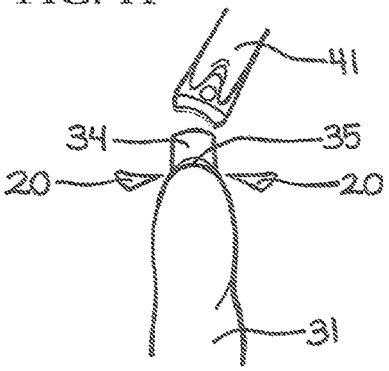
FIG. 11 is a palm-side-up view of the nail supports popping away from the nail as a result of the nail with the adhered supports being clipped.

To remove the under-nail support 20 that is serving as scaffolding for sculpting acrylic 44, use the method illustrated in FIG. 10—simply clip the support 20 from the vertex 29 of the V 28 to the left and from the vertex 29 to the right as illustrated by the bidirectional arrow 45. The under-nail support with its sculpting acrylic will pop off as illustrated in FIG. 11.

What is claimed is:

1. A method for strengthening and supporting long healthy nail growth of a natural nail on a human digit comprising the steps of a. Providing a flexible under-nail support shaped to extend into nail grooves of a user and avoid contact with a hyponychium of a user when attached wherein a proximal edge of the under-nail support is comprised of a first and second edge which meet at an apex and create an indentation that is narrow medially and widens until each edge meets a respective side edge of the support to form a substantially pointed cusp, wherein the respective side edges are substantially parallel;

b. Adhering a proximal edge of the under-nail support under a natural nail's free edge to at least lateral sides of the natural nail;

c. Shaping the under-nail support to a length of the natural nail;

d. Allowing the natural nail with under-nail support adhered to grow naturally;

e. Slightly clipping the natural nail and under-nail support adhered to the natural nail once the under-nail support has grown out leaving part of the natural nail's lateral sides without reinforcement; and, f. removing the under-nail support from the natural nail;

g. Repeating the steps a through f on the natural nail to achieve and maintain desired nail length.

2. A method for rapid lengthening of a natural nail on a human digit comprising the steps of a. Providing a flexible under-nail support shaped as to extend into nail grooves of a user while avoiding contact with a hyponychium of a user and to be longer than the natural nail when attached to the natural nail wherein a proximal edge of the under-nail support is comprised of a first and second edge which meet at an apex and create an indentation that is narrow medially and widens until each edge meets a respective side edge of the support to form a substantially pointed cusp, wherein the respective side edges are substantially parallel;

b. Adhering a proximal edge of the under-nail support under a natural nail's free edge to at least lateral sides of the natural nail;

c. Applying sculpting material atop the under-nail support which serves as a foundation for an artificial nail to be built upon and support for the natural nail; or, d. Applying gel and/or other technologies atop the under-nail support serving as a foundation for an artificial nail to be built upon and support for the natural nail;

e. Grooming the under-nail support with applied sculpting material;

f. Allowing the natural nail to grow naturally;

g. Clipping the under-nail support with applied sculpting material once the under-nail support with applied sculpting material has grown out leaving part of the natural nail's lateral sides without reinforcement;

h. removing the under-nail support from the natural nail; and, i. Repeating the step a through g if the under-nail support with sculpting material or other technology is still needed to lengthen the natural nail.

3. A method for lengthening a natural nail on a human digit then maintaining nail length comprising the steps of a. Proving a flexible under-nail support shaped as to extend into nail grooves of a user while avoiding contact with a hyponychium of a user and to be longer than the natural nail when attached to the natural nail wherein a proximal edge of the under-nail support is comprised of a first and second edge which meet at an apex and create an indentation that is narrow medially and widens until each edge meets a respective side edge of the support to form a substantially pointed cusp, wherein the respective side edges are substantially parallel;

b. Adhering a proximal edge of the under-nail support under a natural nail's free edge to at least lateral sides of the natural nail;

c. Applying sculpting material atop the under-nail support serving as a foundation for an artificial nail to be built upon and support for the natural nail; or, d. Applying gel and/or other technologies atop the under-nail support serving as a foundation for an artificial nail to be built upon and support for the natural nail;

e. Grooming the under-nail support with applied sculpting material;

f. Allowing the natural nail to grow naturally;

g. Clipping the under-nail support with applied sculpting material once the under-nail support with applied sculpting material has grown out leaving part of the natural nail's lateral sides without reinforcement;

h. removing the under-nail support from the natural nail; and, i. Repeating the steps a-g if the under-nail support with sculpting material is still needed to lengthen the natural nail;

j. After the natural nail no longer requires lengthening, adhering the proximal edge of the under-nail support under a natural nail's free edge to at least lateral sides of the natural nail;

k. Shaping the under-nail support to a length of the natural nail;

l. Allowing the natural nail with under-nail support adhered to grow naturally;

m. Slightly clipping the natural nail and under-nail support adhered to the natural nail once growth causes the under-nail support's strength to be compromised leaving part of the natural nail's lateral sides without reinforcement;

n. Popping off the under-nail support manually from the natural nail;

o. Repeating the steps i through m on the natural nail to achieve and maintain desired nail length.

* * * * *